US008636942B2

(12) United States Patent
Komura et al.

(10) Patent No.: US 8,636,942 B2
(45) Date of Patent: Jan. 28, 2014

(54) NONWOVEN FABRIC AND PROCESS FOR PRODUCING THE SAME

(75) Inventors: Shinya Komura, Yamaguchi (JP); Takanori Miyoshi, Yamaguchi (JP); Yoshihiko Sumi, Yamaguchi (JP); Hiroyoshi Minematsu, Yamaguchi (JP)

(73) Assignee: Teijin Limited, Osaka (JP)

( * ) Notice: Subject to any disclaimer, the term of this patent is extended or adjusted under 35 U.S.C. 154(b) by 0 days.

(21) Appl. No.: 12/168,720

(22) Filed: Jul. 7, 2008

(65) Prior Publication Data

US 2008/0272520 A1 Nov. 6, 2008

Related U.S. Application Data

(62) Division of application No. 10/550,912, filed as application No. PCT/JP2004/004501 on Mar. 30, 2004, now abandoned.

(30) Foreign Application Priority Data

Mar. 31, 2003 (JP) ..... 2003-094397

(51) Int. Cl.
*B29C 35/02* (2006.01)
*B29C 47/08* (2006.01)

(52) U.S. Cl.
USPC ..... 264/465; 264/167; 264/172; 264/464; 264/466; 264/484

(58) Field of Classification Search
USPC ..... 264/466, 465, 172, 464, 484, 167
See application file for complete search history.

(56) References Cited

U.S. PATENT DOCUMENTS

| | | | | |
|---|---|---|---|---|
| 4,043,331 | A * | 8/1977 | Martin et al. | 602/45 |
| 4,701,267 | A | 10/1987 | Watanabe et al. | |
| 2002/0100725 | A1 | 8/2002 | Lee et al. | |
| 2002/0175449 | A1 * | 11/2002 | Chu et al. | 264/465 |
| 2002/0192449 | A1 | 12/2002 | Hobbs et al. | |
| 2003/0198820 | A1 * | 10/2003 | Lee et al. | 428/447 |
| 2006/0057350 | A1 | 3/2006 | Ochi et al. | |

FOREIGN PATENT DOCUMENTS

| | | |
|---|---|---|
| EP | 0047795 | 3/1982 |
| GB | 2 360 789 A | 10/2001 |
| JP | 51-40476 A | 4/1976 |
| JP | 57-51809 A | 3/1982 |

(Continued)

OTHER PUBLICATIONS

Cluck, Jessica Marie, "Electeospun Poly(e-caprolactone)(PLC) Nanofibrous Scaffolds for liver tissue engineering", Apr. 2007.*

(Continued)

*Primary Examiner* — Milton I Cano
*Assistant Examiner* — Jeremiah Smith
(74) *Attorney, Agent, or Firm* — Sughrue Mion, PLLC

(57) ABSTRACT

A process for production of a nonwoven fabric, which comprises a step wherein a thermoplastic polymer is dissolved in a mixed solvent composed of a volatile good solvent and a volatile poor solvent, a step wherein the resulting solution is spun by an electrospinning method and a step wherein a nonwoven fabric accumulated on a collecting sheet is obtained, is employed to provide a nonwoven fabric having a surface area sufficiently large as a matrix for cell culturing in the field of regenerative medicine, with large gaps between filaments and a low apparent density suitable for cell culturing.

15 Claims, 22 Drawing Sheets

(56) References Cited

FOREIGN PATENT DOCUMENTS

| | | | |
|---|---|---|---|
| JP | 6-313256 | A | 11/1994 |
| JP | 63-145465 | A | 11/1994 |
| JP | 8-325911 | A | 12/1996 |
| JP | 8-325912 | A | 12/1996 |
| JP | 9-13256 | A | 1/1997 |
| JP | 10-251956 | A | 9/1998 |
| JP | 2002-249966 | A | 9/2002 |
| WO | 02/092339 | A1 | 11/2002 |

OTHER PUBLICATIONS

Bognitzki, M. et al. "Nanostructured Fibers via Electrospinning", Jan. 16, 2001, Wiley-VCH Verlag GmbH, Advanced Materials vol. 13 Issue 1, pp. 70-72.

Thomson, R. et al, Polymer Scaffold Processing, Chapter 21, Principles of Tissue Engineering, Second Edition, pp. 251-262.

Joel D. Stitzel, Journal of Biomaterials Applications 2001, vol. 16 (US), pp. 22-23.

F. Ono, translated by Aizawa, M., Saisei Igaku [Regenerative Medicine] NTS Publications, Jan. 31, 2002, pp. 258-259.

* cited by examiner

NONWOVEN FABRIC AND PROCESS FOR PRODUCING THE SAME

CROSS-REFERENCE TO RELATED APPLICATIONS

This is a divisional application of application Ser. No. 10/550,912 filed Sep. 28, 2005 now abandoned which is a 371 of Application No. PCT/JP 2004/004501 filed Oct. 28, 2004, which claims priority from Japanese Patent Application No. 2003-094397 filed on Mar. 31, 2003; the above noted applications incorporated herein by reference in their entirety.

TECHNICAL FIELD

The present invention relates to an ultralow density nonwoven fabric composed of microfilaments made of a polymer which is soluble in volatile solvents, and to a process for its production.

BACKGROUND ART

Fiber structures are often used as cell growth matrices in the field of regenerative medicine. Investigation of fiber structures include the use of polyglycolic acid employed in surgical sutures and the like (for example, see Non-patent document 1). However, because the fiber structures obtained by such ordinary methods have excessively large fiber sizes, the cell-adhering area is insufficient and fiber structures with smaller fiber sizes have therefore been desired for increased surface area.

On the other hand, methods for producing fiber structures with small fiber sizes include the publicly known electrospinning method (for example, see Patent documents 1 and 2). The electrospinning method comprises a step of introducing a liquid, such as a solution containing a fiber-forming substance, into an electrical field and attracting the liquid toward an electrode to form a fiber substance. Normally, the fiber-forming substance hardens while being attracted from the solution. The hardening is accomplished by, for example, cooling (when the spinning liquid is a solid at room temperature, for example), chemical hardening (treatment with hardening vapor, for example), or solvent evaporation. The obtained fiber substance is captured on an appropriately situated acceptor and may be released therefrom if necessary. The electrospinning method can also directly produce a fiber substance in nonwoven fabric form, and is therefore convenient, requiring no further formation of a fiber structure after reeling.

The use of fiber structures obtained by the electrospinning method as matrices for cell culturing is publicly known. For example, formation of a fiber structure composed of polylactic acid by the electrospinning method, and regeneration of blood vessels by culturing of smooth muscle cells thereon, has been investigated (for example, see Non-patent document 2). However, fiber structures obtained using the electrospinning method tend to be dense structures with short distances between fibers, or in other words, structures with large apparent densities. When such a structure is used as a matrix (scaffold) for cell culturing, the cultured cells accumulate on the surface of each fiber forming the fiber structure as culturing proceeds, forming a thick covering on the fiber surfaces. As a result, it is difficult for solutions containing nutrients and the like to adequately migrate into the fiber structure, such that cell culturing has only been possible near the surfaces of the cells which have been cultured and accumulated on the fiber.

[Patent document 1] Japanese Unexamined Patent Publication SHO No. 63-145465

[Patent document 2] Japanese Unexamined Patent Publication No. 2002-249966

[Non-patent document 1] Ono, F., translated by Aizawa, M., "Saisei Igaku [Regenerative Medicine]", NTS Publications, Jan. 31, 2002, p. 258.

[Non-patent document 2] Joel D. Stitzel, Kristin J. Pawlowski, Gary E. Wnek, David G. Simpson, Gary L. Bowlin, Journal of Biomaterials Applications 2001, Vol. 16 (U.S.), pp. 22-33.

DISCLOSURE OF THE INVENTION

It is a first object of the invention to provide a nonwoven fabric having large gaps between fibers and a sufficient thickness for cell culturing, so as to be suitable for prolonged cell culturing.

It is a second object of the invention to provide a production process which allows the aforementioned nonwoven fabric to be obtained without requiring complex steps such as extraction procedures.

BEST MODE FOR CARRYING OUT THE INVENTION

Figure 1:
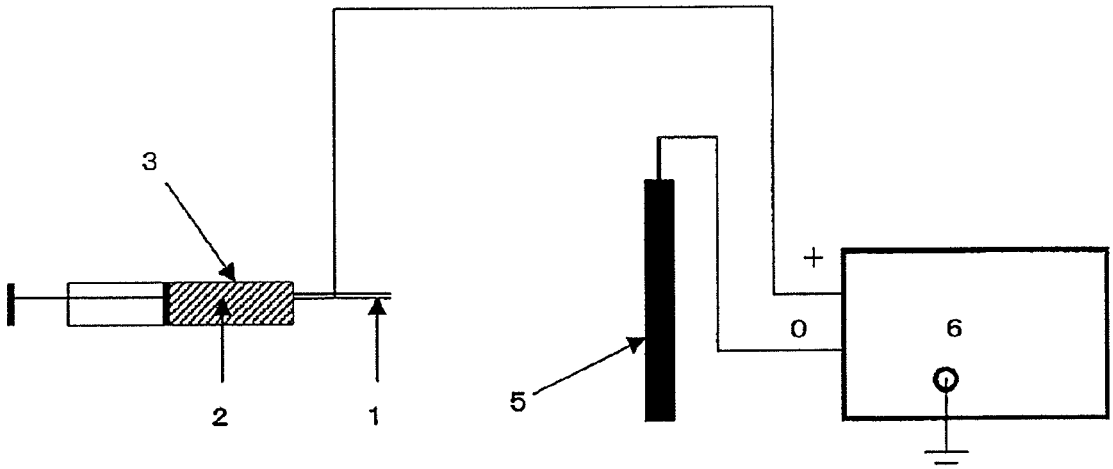
FIG. 1 is a schematic diagram of an apparatus for explanation of a mode of the production process of the invention.

The present invention will now be explained in greater detail.

The nonwoven fabric of the invention is an aggregate of filaments composed of a thermoplastic polymer, and it is characterized by having a mean fiber size of 0.1-20 μm, wherein any given lateral cross-section of the filaments is irregular, and a mean apparent density in the range of 10-95 kg/m$^3$.

According to the invention, a nonwoven fabric is a three-dimensional structure formed by laminating single or multiple filaments and partially anchoring them by interweaving the filaments if necessary.

The nonwoven fabric of the invention consists of an aggregate of filaments having a mean fiber size of 0.1-20 μm, wherein any given lateral cross-section of the filaments is irregular.

The mean fiber size is preferably not less than 0.1 μm because the biodegradability will be too rapid when the fabric is used as a matrix for cell culturing for the purpose of regenerative medicine. The mean fiber size is also preferably not greater than 20 μm because the cell-adhering area will be too small. More preferably, the mean fiber size is 0.1-5 μm, and even more preferably the mean fiber size is 0.1-4 μm.

According to the invention, the fiber size is the diameter of the lateral cross-section of a filament, and in the case of an elliptical filament cross-sectional shape, the fiber size is calculated as the average between the length in the long axis direction and the length in the short axis direction of the ellipse. Although the filament of the invention has an irregular shape and its lateral cross-section is not perfectly circular, calculation of the fiber size assumes a perfect circular shape.

When any given lateral cross-section of the filament is irregular, the specific surface area of the filament increases so that sufficient area is available for cellular adhesion to the filament surfaces during cell culturing.

The phrase "any given lateral cross-section of the filament is irregular" means that any given lateral cross-section of the filament has a shape which is not an approximately perfect circular shape, and this includes, for example, filaments wherein any given lateral cross-section is irregular due to roughness of the filament surfaces as a result of pits and/or protrusions, even if the lateral cross-section of the filament is an approximately perfect circle.

The aforementioned irregular shape is preferably at least one type selected from the group consisting of fine pits on the filament surfaces, fine protrusions on the filament surfaces, pits formed in a linear fashion in the fiber axis direction on the filament surfaces, protrusions formed in a linear fashion in the fiber axis direction on the filament surfaces and micropores in the filament surfaces, formed either alone or present in combinations so long as any given lateral cross-section is irregular.

The terms "fine pits" and "fine protrusions" refer respectively to pits and protrusions formed to 0.1-1 μm on the filament surfaces, while "micropores" refers to pores of diameter 0.1-1 μm present in the filament surfaces. Pits and/or protrusions formed in a linear fashion are those wherein furrow shapes with a width of 0.1-1 μm are formed in the fiber axis direction.

The nonwoven fabric of the invention has a mean apparent density of 10-95 kg/m$^3$. The mean apparent density is the density calculated from the area, average thickness and weight of the produced nonwoven fabric, and the more preferred mean apparent density range is 50-90 kg/m$^3$.

The mean apparent density is preferably not greater than 95 kg/m$^3$ because this will prevent adequate penetration of nutrient-containing solutions to the interior of the nonwoven fabric during cell culturing, resulting in cell culturing only on the nonwoven fabric surface. The mean apparent density is also preferably not less than 10 kg/m$^3$ because this will not allow the necessary dynamic strength to be sustained during cell culturing.

The nonwoven fabric of the invention is an aggregate of filaments composed of a thermoplastic polymer, where the thermoplastic polymer is not particularly restricted so long as it is a polymer with a thermoplastic property and suitable for use as a nonwoven fabric; it preferably consists of a polymer which is soluble in a volatile solvent.

The volatile solvent referred to here is an organic substance having a boiling point of no greater than 200° C. at atmospheric pressure, and liquid at ordinary temperature (for example, 27° C.), while "soluble" means that a solution containing the polymer at 1 wt % exists stably without precipitation at ordinary temperature (for example, 27° C.).

As polymers which are soluble in volatile solvents there may be mentioned polylactic acid, polyglycolic acid, polylactic acid-polyglycolic acid copolymer, polycaprolactone, polybutylene succinate, polyethylene succinate, polystyrene, polycarbonate, polyhexamethylene carbonate, polyallylate, polyvinyl isocyanate, polybutyl isocyanate, polymethyl methacrylate, polyethyl methacrylate, poly-n-propyl methacrylate, poly-n-butyl methacrylate, polymethyl acrylate, polyethyl acrylate, polybutyl acrylate, polyacrylonitrile, cellulose diacetate, cellulose triacetate, methyl cellulose, propyl cellulose, benzyl cellulose, fibroin, natural rubber, polyvinyl acetate, polyvinyl methyl ether, polyvinyl ethyl ether, polyvinyl n-propyl ether, polyvinyl isopropyl ether, polyvinyl n-butyl ether, polyvinyl isobutyl ether, polyvinyl tert-butyl ether, polyvinyl chloride, polyvinylidene chloride, poly(N-vinylpyrrolidone), poly(N-vinylcarbazole), poly(4-vinylpyridine), polyvinyl methyl ketone, polymethyl isopropenyl ketone, polyethylene oxide, polypropylene oxide, polycyclopentene oxide, polystyrenesulfone and their copolymers.

As preferred examples among these there may be mentioned aliphatic polyesters such as polylactic acid, polyglycolic acid, polylactic acid-polyglycolic acid copolymer, polycaprolactone, polybutylene succinate, polyethylene succinate and their copolymers, and as more preferred examples there may be mentioned polylactic acid, polyglycolic acid, polylactic acid-polyglycolic acid copolymer and polycaprolactone. Polylactic acid is particularly preferred.

According to the invention, other polymers or other compounds (for example, copolymers, polymer blends, compounds mixtures and the like) may also be used so long as the intended purpose is not impeded.

The volatile solvent may also be a mixed solvent comprising a volatile good solvent and a volatile poor solvent, in which case the ratio of the volatile poor solvent and volatile good solvent in the mixed solvent is preferably in the range of (23:77) to (40:60), based on weight.

A "volatile good solvent" is a solvent with a boiling point of no higher than 200° C. at atmospheric pressure and capable of dissolving the polymer at 5 wt % or greater, while a "volatile poor solvent" is a solvent with a boiling point of no higher than 200° C. at atmospheric pressure and capable of dissolving the polymer only up to 1 wt %.

Examples of volatile good solvents include halogen-containing hydrocarbons, and examples of volatile poor solvents include lower alcohols, of which ethanol is a typical example.

Although the shape of the nonwoven fabric of the invention is not restricted and may be rectangular, circular, cylindrical or the like, secondary processing of the nonwoven fabric, such as lamination with other sheet materials or processing into a mesh form, will be facilitated from the standpoint of handleability if the thickness of the nonwoven fabric is at least 100 μm, while thicker structures can be formed by stacking nonwoven fabrics together.

The process for producing the nonwoven fabric of the invention may be any method which yields a nonwoven fabric satisfying the conditions described above, and is otherwise not particularly restricted. For example, after obtaining the filament by a melt spinning method, dry spinning method or wet spinning method, the obtained filament may be subjected to a spunbond method, a melt blow method or an electrospinning method for production. Production by electrospinning is preferred. A production process by electrospinning will now be explained in detail.

The production process of the invention comprises a step wherein the thermoplastic polymer is dissolved in a mixed solvent composed of a volatile good solvent and a volatile poor solvent, a step wherein the resulting solution is spun by an electrospinning method and a step wherein a nonwoven fabric accumulated on a collecting sheet is obtained, and the process yields a nonwoven fabric with a mean fiber size of 0.1-20 μm, wherein any given lateral cross-section of the filaments is irregular, and a mean apparent density in the range of 10-95 kg/m$^3$.

In other words, the nonwoven fabric of the invention may be obtained as an aggregate of a fiber substance formed by discharging a solution of the thermoplastic polymer in a mixed solvent composed of a volatile good solvent and a volatile poor solvent into an electrostatic field formed between electrodes, and attracting the solution toward the electrodes.

The concentration of the thermoplastic polymer in the solution used for the production process of the invention is preferably 1-30 wt %. The thermoplastic polymer concentration is preferably not less than 1 wt % because the low concentration will render it difficult to form a nonwoven fabric. A concentration of greater than 30 wt % is also not preferred because the fiber size of the resulting nonwoven fabric will be too large. A more preferred range for the thermoplastic polymer concentration is 2-20 wt %.

The volatile good solvent is not particularly restricted so long as it satisfies the conditions described above and its mixture with the volatile poor solvent dissolves the fiber-forming polymer to a sufficient concentration for spinning. As specific examples of volatile good solvents there may be mentioned halogen-containing hydrocarbons such as methylene chloride, chloroform, bromoform and carbon tetrachloride, as well as acetone, toluene, tetrahydrofuran, 1,1,1,3,3,3-hexafluoroisopropanol, 1,4-dioxane, cyclohexanone, N,N'-dimethylformamide and acetonitrile. Methylene chloride and chloroform are particularly preferred among these from the standpoint of solubility of the polymer. These volatile good solvents may be used alone, or a combination of multiple volatile good solvents may be used.

The volatile poor solvent is not particularly restricted so long as it satisfies the conditions described above and dissolves the polymer in admixture with the volatile good solvent but does not dissolve the polymer alone. As specific examples of volatile poor solvents there may be mentioned methanol, ethanol, n-propanol, iso-propanol, 1-butanol, 2-butanol, water, formic acid, acetic acid and propionic acid. Lower alcohols such as methanol, ethanol and propanol are preferred among these from the standpoint of structural formation of the nonwoven fabric, and ethanol is particularly preferred. These volatile poor solvents may be used alone, or a combination of multiple volatile poor solvents may be used.

The mixed solvent used for the production process of the invention preferably has a ratio of the volatile poor solvent and volatile good solvent in the range of (23:77) to (40:60), based on weight.

The range is more preferably (25:75) to (40:60), and most preferably (30:70) to (40:60) as a weight percentage.

The composition may exhibit phase separation depending on the combination of the volatile good solvent and the volatile poor solvent, and while stable spinning cannot be accomplished by electrospinning if the solution composition undergoes phase separation, any proportion which does not produce a phase-separating composition is suitable.

Any desired method may be employed for discharge of the solution into the electrostatic field.

A preferred mode for production of a fiber structure of the invention will now be explained in detail with respect to FIG. 1.

The solution (2 in FIG. 1) is supplied to a nozzle in such a manner that the solution is situated at an appropriate position in the electrostatic field, and the solution is attracted from the nozzle by the electric field to form a filament. A suitable apparatus may be used for this purpose, and for example, appropriate means, for example, a solution syringe needle-shaped ejection nozzle (1 in FIG. 1), having a voltage applied thereto with a high voltage generator (6 in FIG. 1), may be fitted at the tip of a cylindrical solution holding retainer (3 in FIG. 1) of a syringe, and the solution guided through to the tip.

The tip of the ejection nozzle (1 in FIG. 1) is set at an appropriate distance from a grounded fiber substance-collecting electrode (5 in FIG. 1), and a fiber substance is formed between this tip and the fiber substance-collecting electrode (5 in FIG. 1) when the solution (2 in FIG. 1) exits the tip of the ejection nozzle (1 in FIG. 1).

Figure 2:
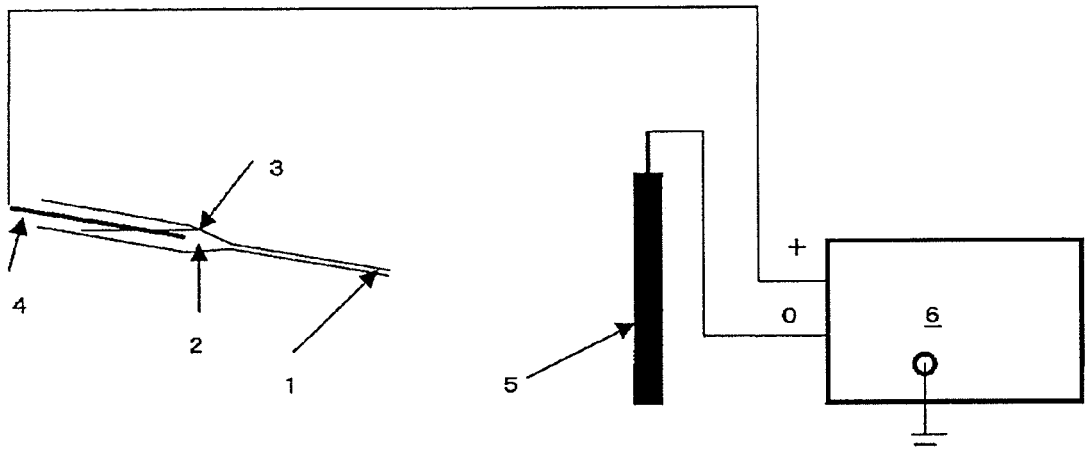
FIG. 2 is a schematic diagram of an apparatus for explanation of a mode of the production process of the invention.
Figure 3:
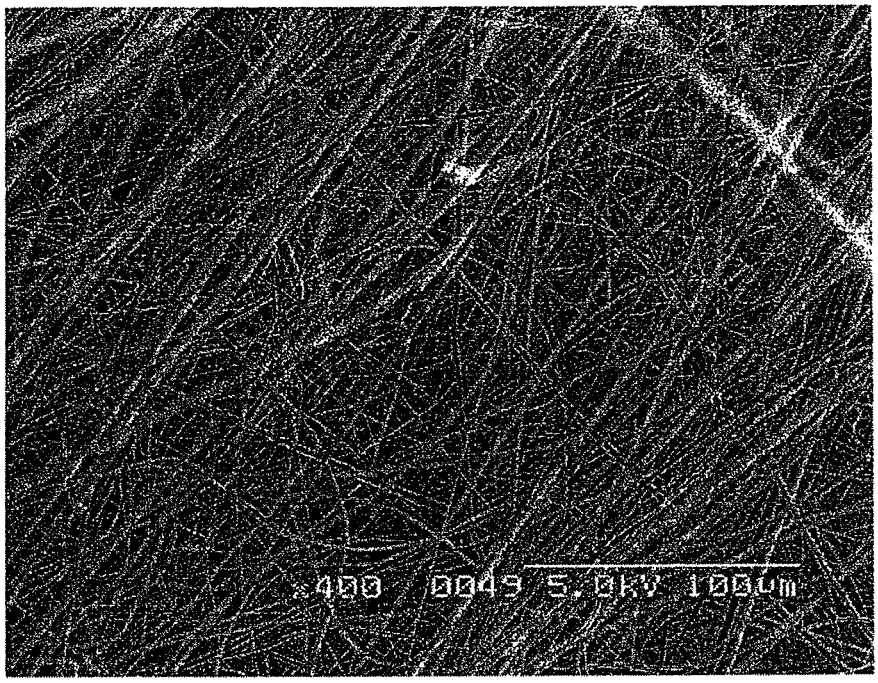
FIG. 3 is an electron microscope photograph (400× magnification) of the surface of a fiber structure obtained by the procedure of Example 1.
Figure 4:
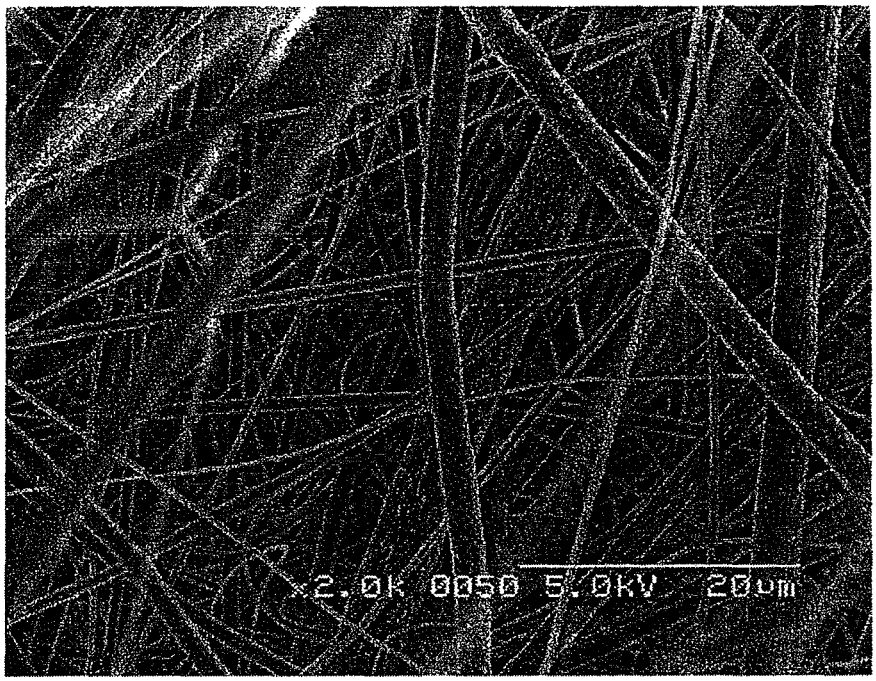
FIG. 4 is an electron microscope photograph (2000× magnification) of the surface of a fiber structure obtained by the procedure of Example 1.
Figure 5:
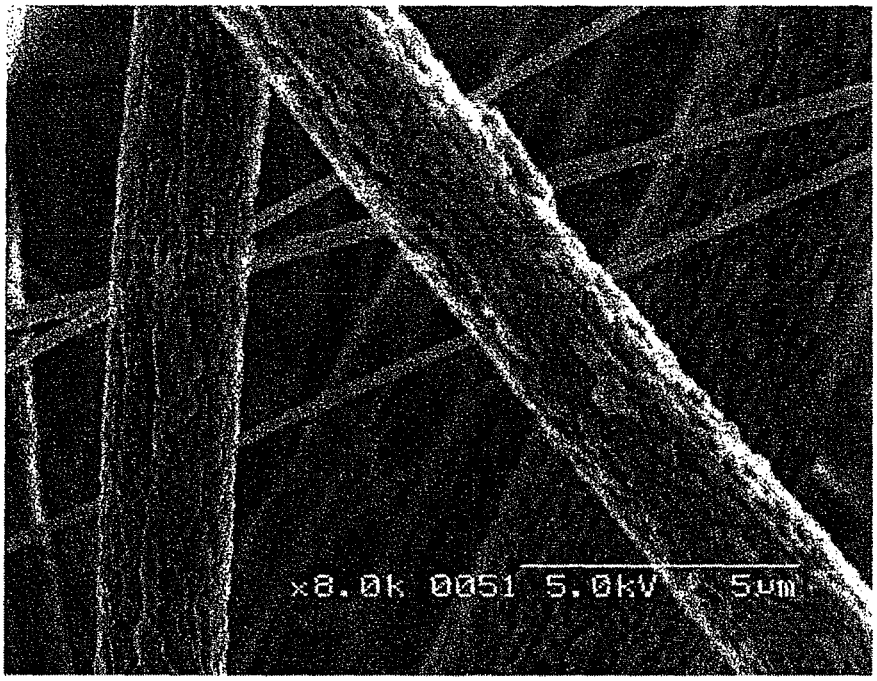
FIG. 5 is an electron microscope photograph (8000× magnification) of the surface of a fiber structure obtained by the procedure of Example 1.
Figure 6:
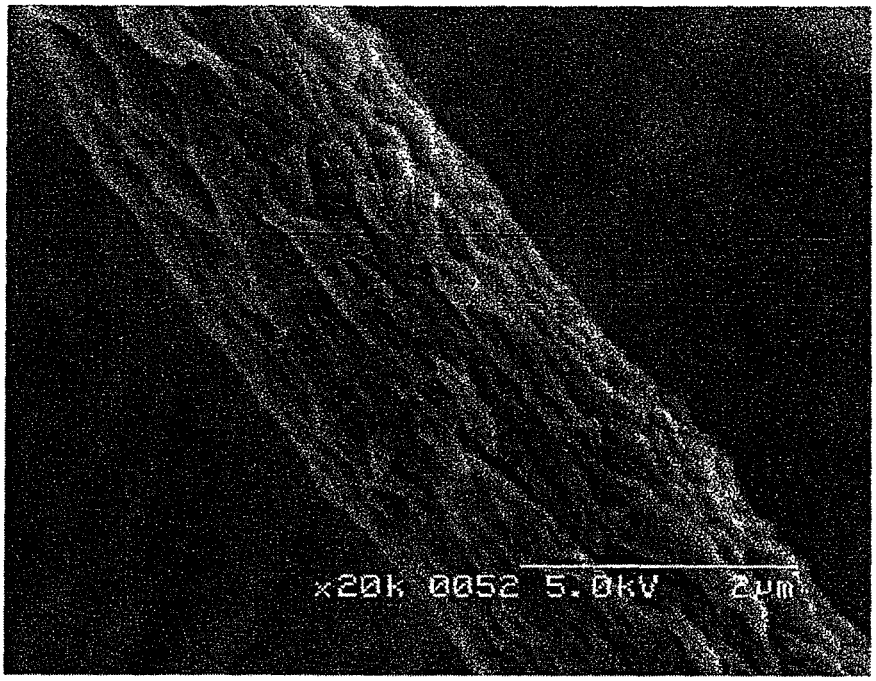
FIG. 6 is an electron microscope photograph (20,000× magnification) of the surface of a fiber structure obtained by the procedure of Example 1.
Figure 7:
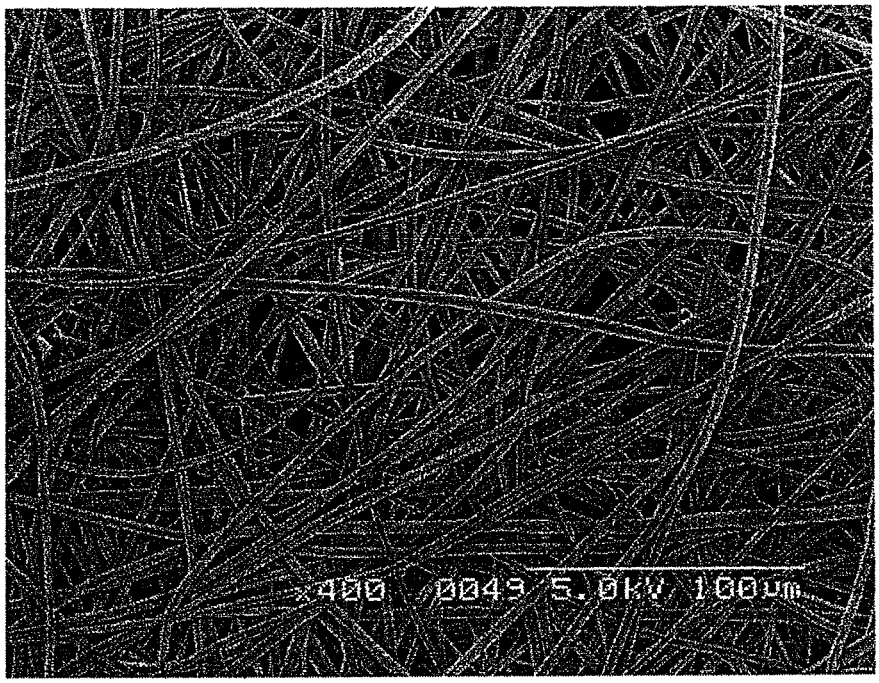
FIG. 7 is an electron microscope photograph (400× magnification) of the surface of a fiber structure obtained by the procedure of Example 2.
Figure 8:
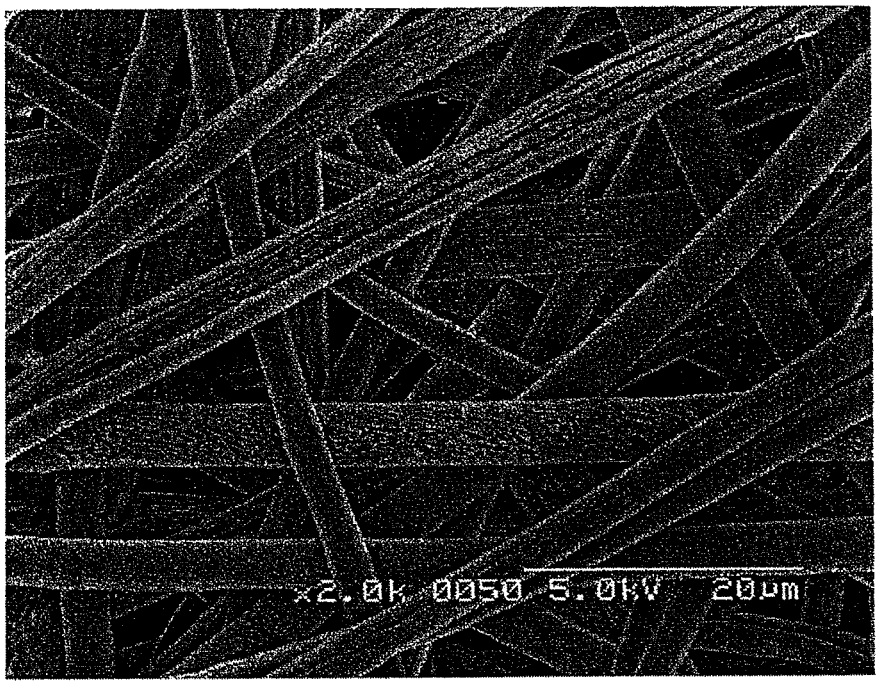
FIG. 8 is an electron microscope photograph (2000× magnification) of the surface of a fiber structure obtained by the procedure of Example 2.
Figure 9:
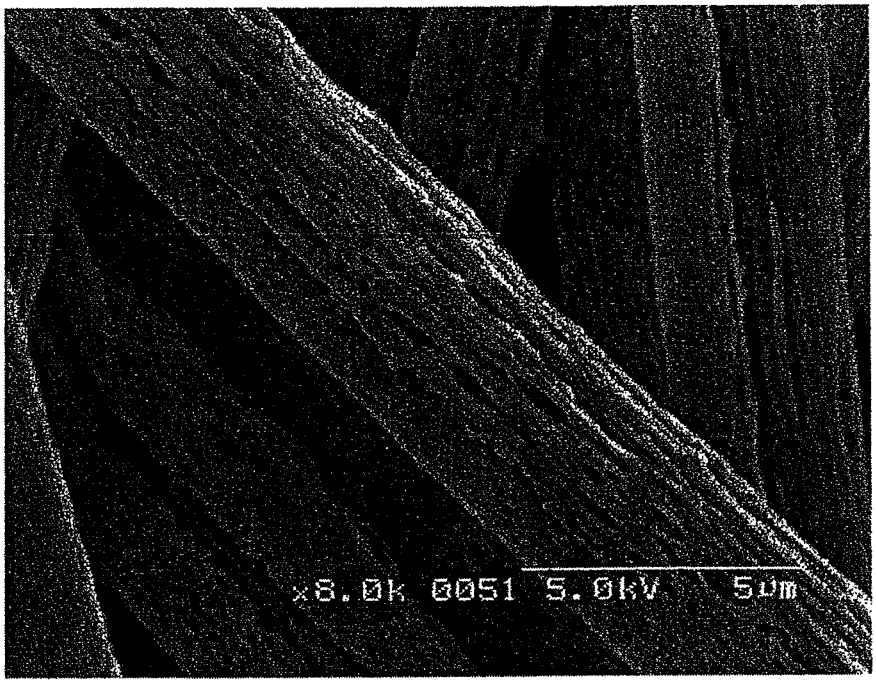
FIG. 9 is an electron microscope photograph (8000× magnification) of the surface of a fiber structure obtained by the procedure of Example 2.
Figure 10:
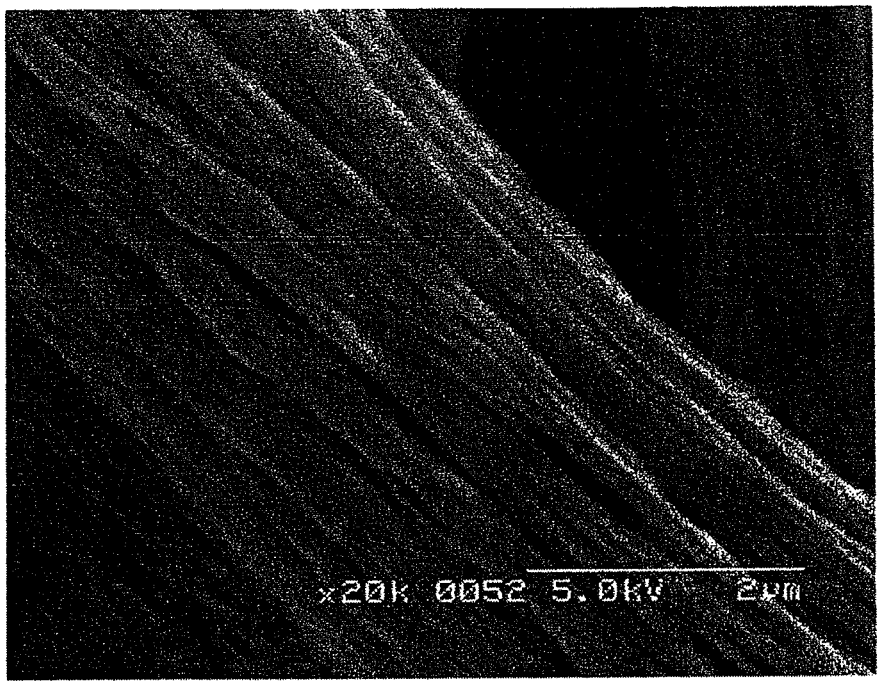
FIG. 10 is an electron microscope photograph (20,000× magnification) of the surface of a fiber structure obtained by the procedure of Example 2.

Fine droplets of the solution may also be introduced into the electrostatic field by a method which is self-evident to a person skilled in the art. An example thereof will now be explained with reference to FIG. 2. The sole condition in this case is that the liquid droplets are held away from the fiber substance-collecting electrode (5 in FIG. 2) at a distance such that no fiber formation can occur in the electrostatic field. For example, an electrode (4 in FIG. 2) directly opposite the fiber substance-collecting electrode may be inserted directly into the solution (2 in FIG. 2) in the solution holding retainer (3 in FIG. 2) comprising the nozzle (1 in FIG. 2).

When the solution is supplied from the nozzle into the electrostatic field, several nozzles may be used to increase the fiber substance production speed. The distance between the electrodes will depend on the charge, the nozzle dimensions, the spinning solution flow rate and the spinning solution concentration, but a distance of 5-20 cm is appropriate for about 10 kV.

The electrostatic potential applied will usually be 3-100 kV, preferably 5-50 kV and more preferably 5-30 kV. The prescribed electrostatic potential may be created by any desired appropriate method among the conventional publicly known techniques.

The aforementioned explanation assumes that the electrode is also used as the collecting sheet, but if another member which can serve as the collecting sheet is situated between the electrodes, it will be possible to provide a collecting sheet separate from the electrodes for collection of the fiber laminate (nonwoven fabric). In this case, for example, a belt-shaped substance may be situated between the electrodes and used as the collecting sheet for continuous production.

The electrodes in this case may be metal, inorganic or organic, the only requirement being that of exhibiting conductivity. They may also have conductive metal, inorganic or organic thin-films formed on insulating materials.

The electrostatic field mentioned above is formed between a pair of or multiple electrodes, and a high voltage may be applied to all of the electrodes. This includes cases with a total of three electrodes, i.e. two high-voltage electrodes with different voltage levels (for example, 15 kV and 10 kV) and a ground connection, as well as cases employing more than three electrodes.

According to the invention, a fiber substance is formed due to the conditions of evaporation of the solvent as the solution is drawn out toward the collecting sheet. Under normal atmospheric pressure and room temperature (about 25° C.), the solvent will completely evaporate during collection onto the collecting sheet, but filament drawing may be achieved under reduced pressure conditions if the solvent evaporation is insufficient. The temperature of the atmosphere for the filament drawing will depend on the evaporation behavior of the solvent and the viscosity of the spinning solution, but will usually be 0-50° C. A nonwoven fabric of the invention may be produced by further accumulating the fiber substance on the collecting sheet.

A single nonwoven fabric obtained according to the invention may be used alone, or it may be used in combination with another material in consideration of handleability and other required aspects. For example, a nonwoven fabric or woven fabric, film or the like which can serve as a support base may be used as the collecting sheet and the nonwoven fabric according to the invention formed thereover, to fabricate a member comprising a combination of the support base and the nonwoven fabric of the invention.

Use of the nonwoven fabric obtained according to the invention is not limited to a cell culturing matrix for regenerative medicine, as the nonwoven fabric may be used for other various purposes which take advantage of the characteristic properties of the invention, such as filters, catalyst support materials and the like.

EXAMPLES

The present invention will now be explained in greater detail by examples, with the understanding that the invention is in no way limited to the examples. The properties evaluated in the examples and comparative examples were determined by the following methods.

Mean Fiber Size:

The sample surface was photographed with a scanning electron microscope ("S-2400" by Hitachi Laboratories Co., Ltd.) (2000× magnification), and then 20 random locations were selected from the photograph for fiber size measurement and the average of all of the fiber sizes (n=20) was calculated to determine the mean fiber size.

Nonwoven Fabric Thickness:

A high-precision linear gauge ("LITEMATIC VL-50" by Mitutoyo Corp.) was used to measure the thickness at 5 random locations with a measuring force of 0.01 N, and the average of all of the thicknesses (n=5) was calculated as the nonwoven fabric thickness. The measurement was conducted with the minimum measuring force possible with the gauge.

Mean Apparent Density:

The volume (area×thickness) and weight of the obtained nonwoven fabric were measured and the mean apparent density was calculated.

Example 1

At room temperature (25° C.) there were combined 1 part by weight of polylactic acid ("Lacty 9031" by Shimadzu Corp.), 3 parts by weight of ethanol (reagent grade, by Wako Pure Chemical Industries Co., Ltd.) and 6 parts by weight of methylene chloride (reagent grade, by Wako Pure Chemical Industries Co., Ltd.) to prepare a solution. The apparatus shown in FIG. 2 was used for discharge of the solution to a fiber substance-collecting electrode 5 for a period of 15 minutes.

The inner diameter of the discharge nozzle 1 was 0.8 mm, the voltage was 12 kV, and the distance from the discharge nozzle 1 to the fiber substance-collecting electrode 5 was 10 cm. The mean fiber size of the obtained nonwoven fabric was 2 μm, and no filaments with a fiber size of greater than 10 μm were observed. The nonwoven fabric thickness was 300 μm, and the mean apparent density was 68 kg/m$^3$. Scanning electron micrographs of the nonwoven fabric surface are shown in FIGS. 3 to 6.

Example 2

The same procedure was carried out as in Example 1, except for using 1 part by weight of polylactic acid ("Lacty 9031" by Shimadzu Corp.), 3.5 parts by weight of ethanol (reagent grade, by Wako Pure Chemical Industries Co., Ltd.) and 5.5 parts by weight of methylene chloride (reagent grade, by Wako Pure Chemical Industries Co., Ltd.). The mean fiber size was 4 μm, and no filaments with a fiber size of greater than 10 μm were observed. The nonwoven fabric thickness was 360 μm, and the mean apparent density was 54 kg/m$^3$.

Scanning electron micrographs of the nonwoven fabric surface are shown in FIGS. 7 to 10.

Example 3

The same procedure was carried out as in Example 1, except for using 1 part by weight of polylactic acid ("Lacty 9031" by Shimadzu Corp.), 3 parts by weight of methanol (reagent grade, by Wako Pure Chemical Industries Co., Ltd.) and 6 parts by weight of methylene chloride (reagent grade, by Wako Pure Chemical Industries Co., Ltd.). The mean fiber size was 2 μm, and no filaments with a fiber size of greater than 10 μm were observed. The nonwoven fabric thickness was 170 μm, and the mean apparent density was 86 kg/m$^3$.

Figure 11:
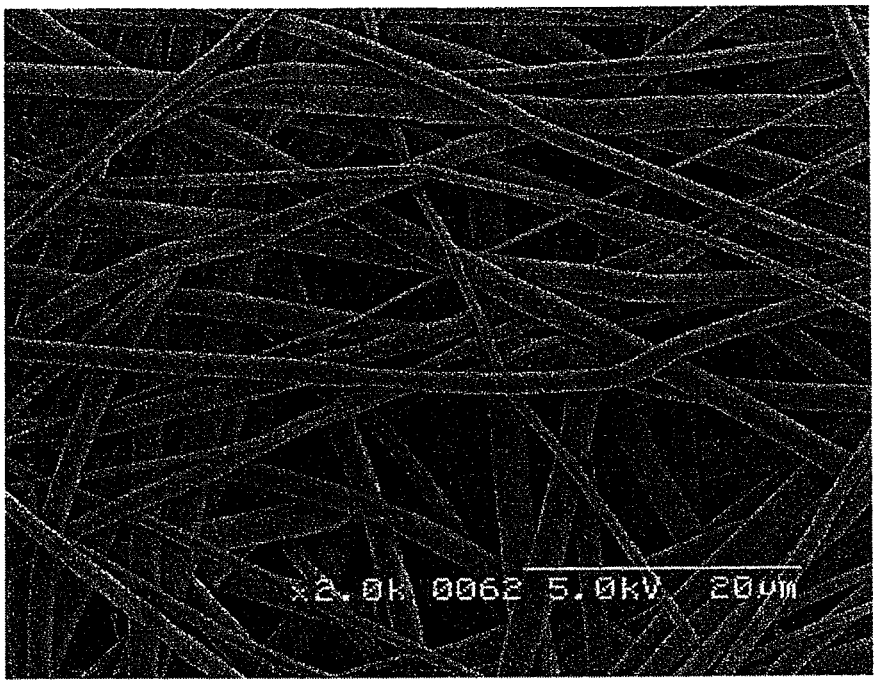
FIG. 11 is an electron microscope photograph (2000× magnification) of the surface of a fiber structure obtained by the procedure of Example 3.
Figure 12:
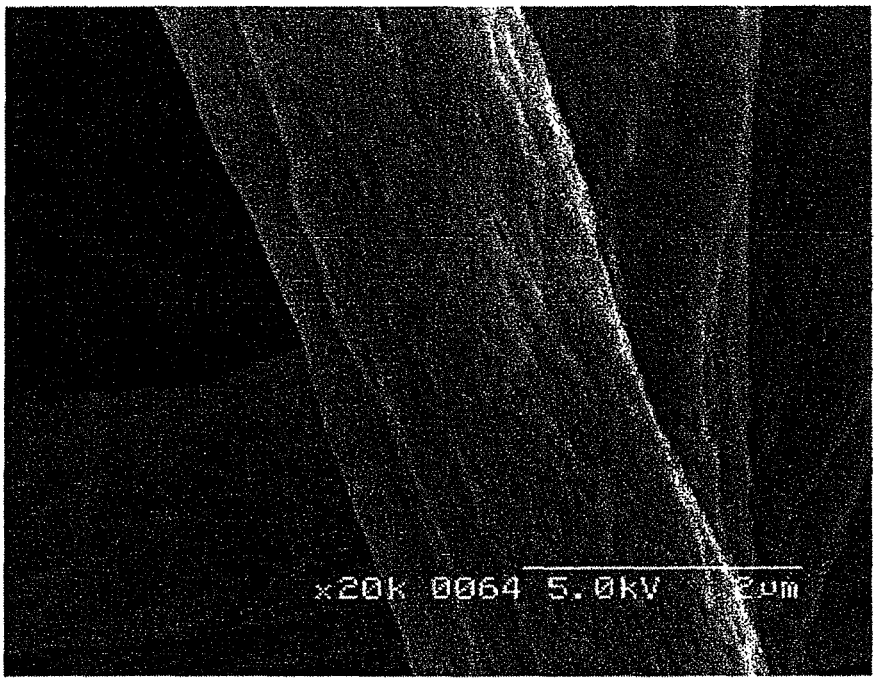
FIG. 12 is an electron microscope photograph (20,000× magnification) of the surface of a fiber structure obtained by the procedure of Example 3.

Scanning electron micrographs of the nonwoven fabric surface are shown in FIGS. 11 and 12.

Example 4

The same procedure was carried out as in Example 1, except for using 1 part by weight of polylactic acid ("Lacty 9031" by Shimadzu Corp.), 3 parts by weight of isopropanol (reagent grade, by Wako Pure Chemical Industries Co., Ltd.) and 6 parts by weight of methylene chloride (reagent grade, by Wako Pure Chemical Industries Co., Ltd.). The mean fiber size was 4 μm, and no filaments with a fiber size of greater than 10 μm were observed. The nonwoven fabric thickness was 170 μm, and the mean apparent density was 73 kg/m$^3$.

Figure 13:
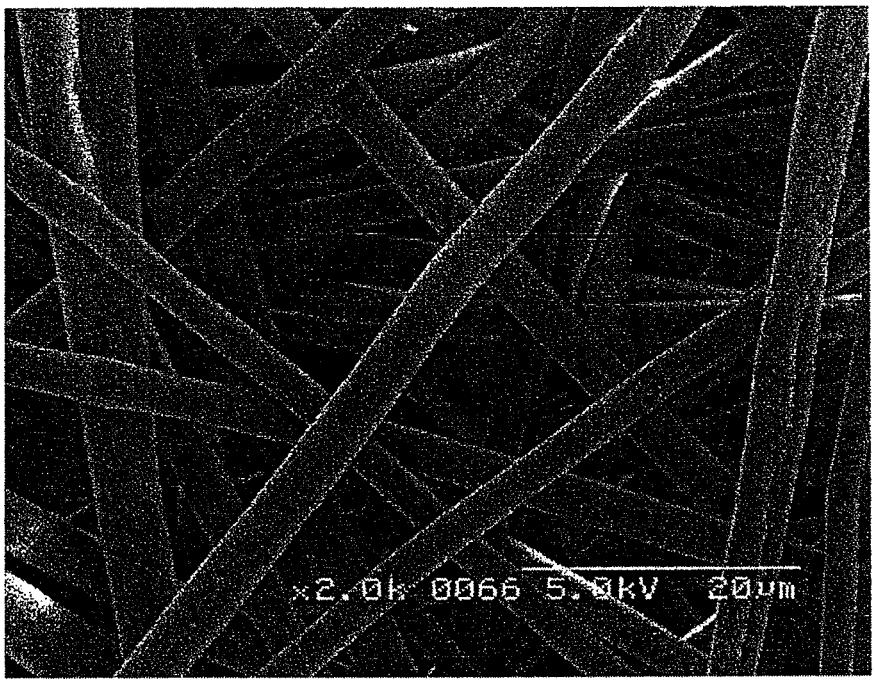
FIG. 13 is an electron microscope photograph (2000× magnification) of the surface of a fiber structure obtained by the procedure of Example 4.
Figure 14:
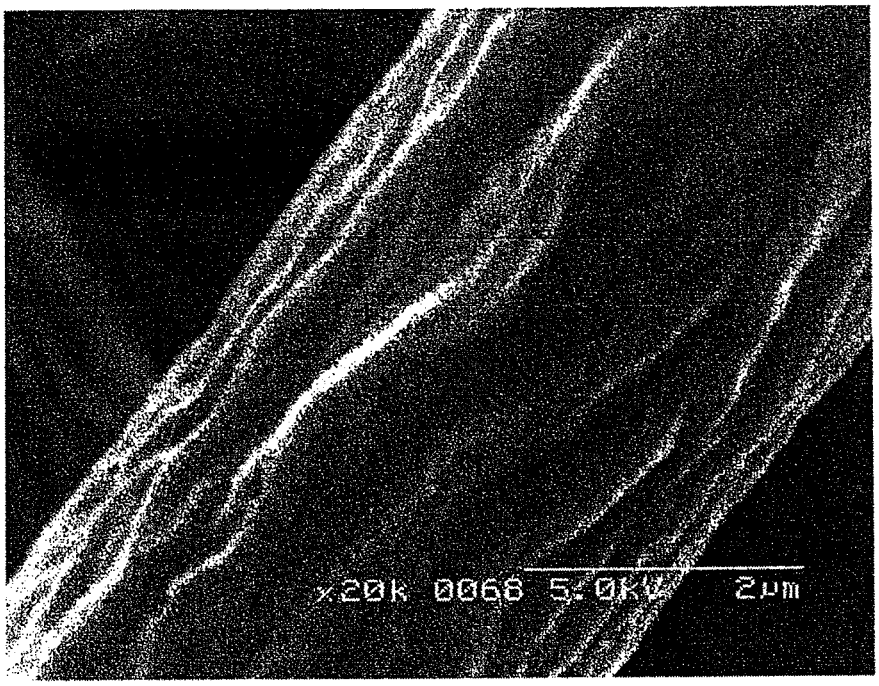
FIG. 14 is an electron microscope photograph (20,000× magnification) of the surface of a fiber structure obtained by the procedure of Example 4.

Scanning electron micrographs of the nonwoven fabric surface are shown in FIGS. 13 and 14.

Comparative Example 1

The same procedure was carried out as in Example 1, except for using 1 part by weight of polylactic acid ("Lacty 9031" by Shimadzu Corp.), 0.5 part by weight of ethanol (reagent grade, by Wako Pure Chemical Industries Co., Ltd.) and 8.5 parts by weight of methylene chloride (reagent grade, by Wako Pure Chemical Industries Co., Ltd.). The mean fiber size was 5 μm, and no filaments with a fiber size of greater than 15 μm were observed. The nonwoven fabric thickness was 140 μm, and the mean apparent density was 180 kg/m$^3$.

Figure 15:
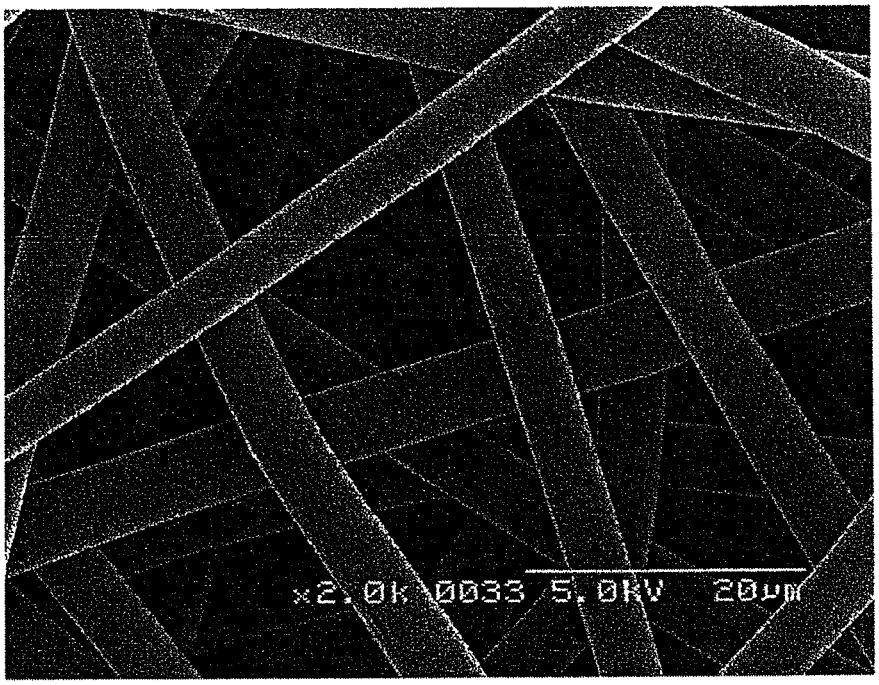
FIG. 15 is an electron microscope photograph (2000× magnification) of the surface of a fiber structure obtained by the procedure of Comparative Example 1.
Figure 16:
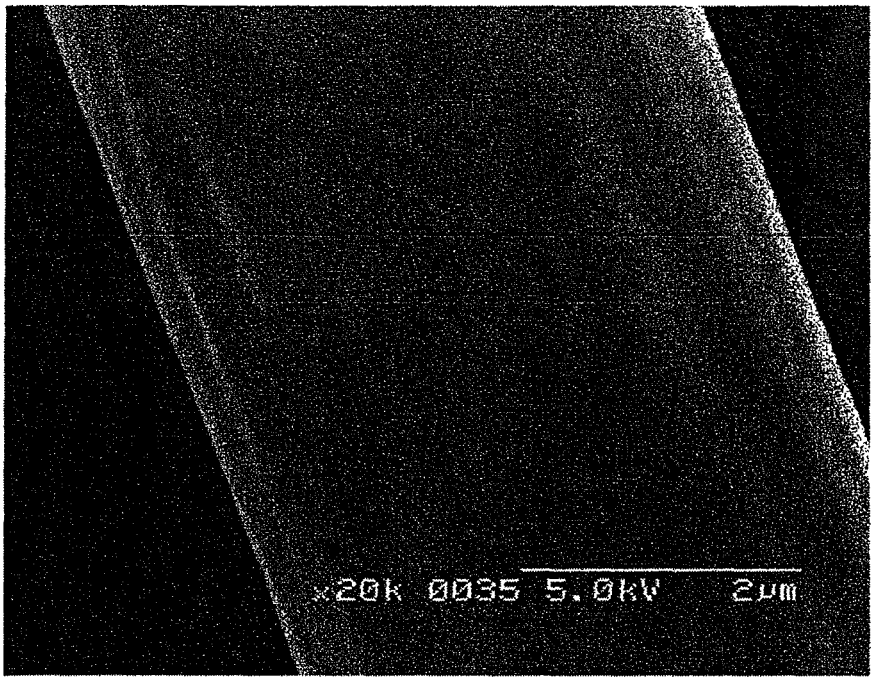
FIG. 16 is an electron microscope photograph (20,000× magnification) of the surface of a fiber structure obtained by the procedure of Comparative Example 1.

Scanning electron micrographs of the nonwoven fabric surface are shown in FIGS. 15 and 16.

Comparative Example 2

The same procedure was carried out as in Example 1, except for using 1 part by weight of polylactic acid ("Lacty 9031" by Shimadzu Corp.), 1 part by weight of ethanol (reagent grade, by Wako Pure Chemical Industries Co., Ltd.) and 8 parts by weight of methylene chloride (reagent grade, by Wako Pure Chemical Industries Co., Ltd.). The mean fiber size was 2 μm, and no filaments with a fiber size of greater than 10 μm were observed. The nonwoven fabric thickness was 140 μm, and the mean apparent density was 160 kg/m$^3$.

Comparative Example 3

The same procedure was carried out as in Example 1, except for using 1 part by weight of polylactic acid ("Lacty 9031" by Shimadzu Corp.), 2 parts by weight of ethanol (reagent grade, by Wako Pure Chemical Industries Co., Ltd.) and 7 parts by weight of methylene chloride (reagent grade, by Wako Pure Chemical Industries Co., Ltd.). The mean fiber size was 7 μm, and no filaments with a fiber size of greater than 15 μm were observed. The nonwoven fabric thickness was 110 μm, and the mean apparent density was 140 kg/m$^3$.

Comparative Example 4

It was attempted to prepare a solution using 1 part by weight of polylactic acid ("Lacty 9031" by Shimadzu Corp.), 4 parts by weight of ethanol (reagent grade, by Wako Pure Chemical Industries Co., Ltd.) and 5 parts by weight of methylene chloride (reagent grade, by Wako Pure Chemical Industries Co., Ltd.), but although the polylactic acid dissolved, phase separation prevented preparation of a uniform solution, and therefore filament formation by electrospinning was impossible.

Example 5

The same procedure was carried out as in Example 1, except for using 1 part by weight of polylactic acid ("Lacty 9031" by Shimadzu Corp.), 3 parts by weight of acetone (reagent grade, by Wako Pure Chemical Industries Co., Ltd.) and 6 parts by weight of methylene chloride (reagent grade, by Wako Pure Chemical Industries Co., Ltd.). The mean fiber size was 2 μm, and no filaments with a fiber size of greater than 5 μm were observed. The nonwoven fabric thickness was 140 μm, and the mean apparent density was 82 kg/m$^3$.

Figure 17:
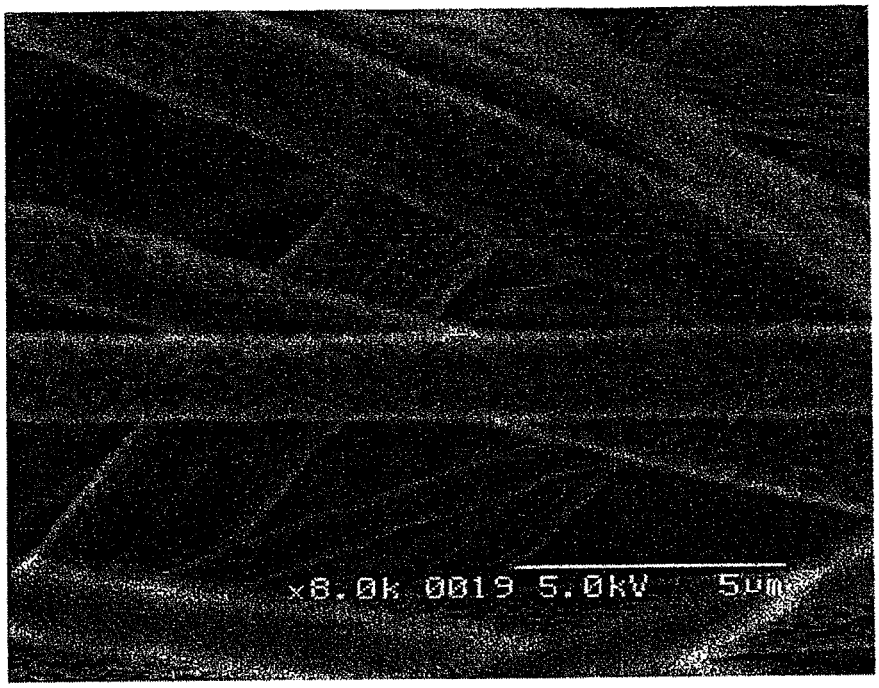
FIG. 17 is an electron microscope photograph (8000× magnification) of the surface of a fiber structure obtained by the procedure of Example 5.
Figure 18:
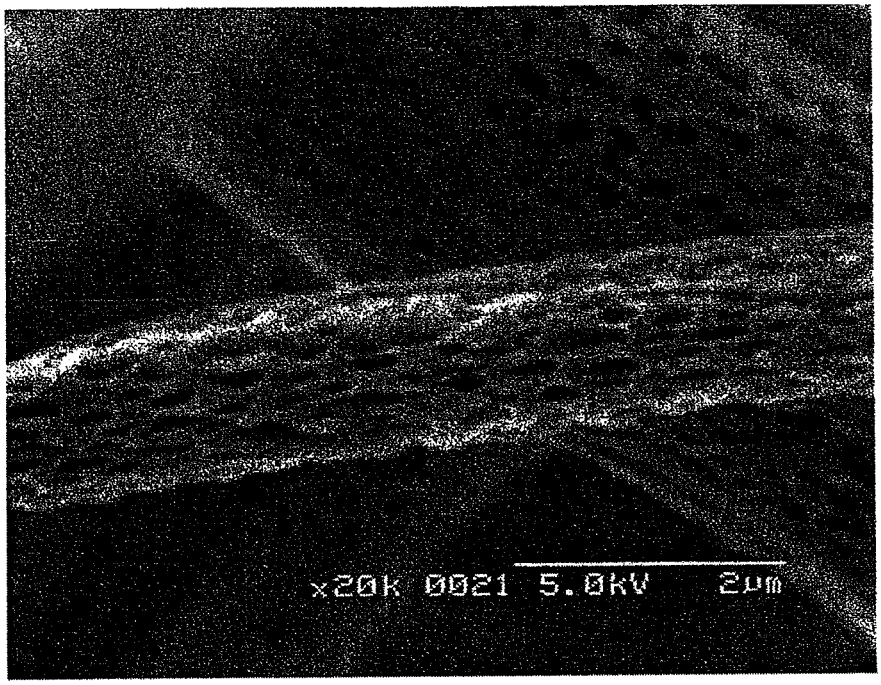
FIG. 18 is an electron microscope photograph (20,000× magnification) of the surface of a fiber structure obtained by the procedure of Example 5.

Scanning electron micrographs of the nonwoven fabric surface are shown in FIGS. 17 and 18.

Example 6

The same procedure was carried out as in Example 1, except for using 1 part by weight of polylactic acid ("Lacty 9031" by Shimadzu Corp.), 3 parts by weight of acetonitrile (reagent grade, by Wako Pure Chemical Industries Co., Ltd.) and 6 parts by weight of methylene chloride (reagent grade, by Wako Pure Chemical Industries Co., Ltd.). The mean fiber size was 0.9 μm, and no filaments with a fiber size of greater than 5 μm were observed. The nonwoven fabric thickness was 290 μm, and the mean apparent density was 74 kg/m$^3$.

Figure 19:
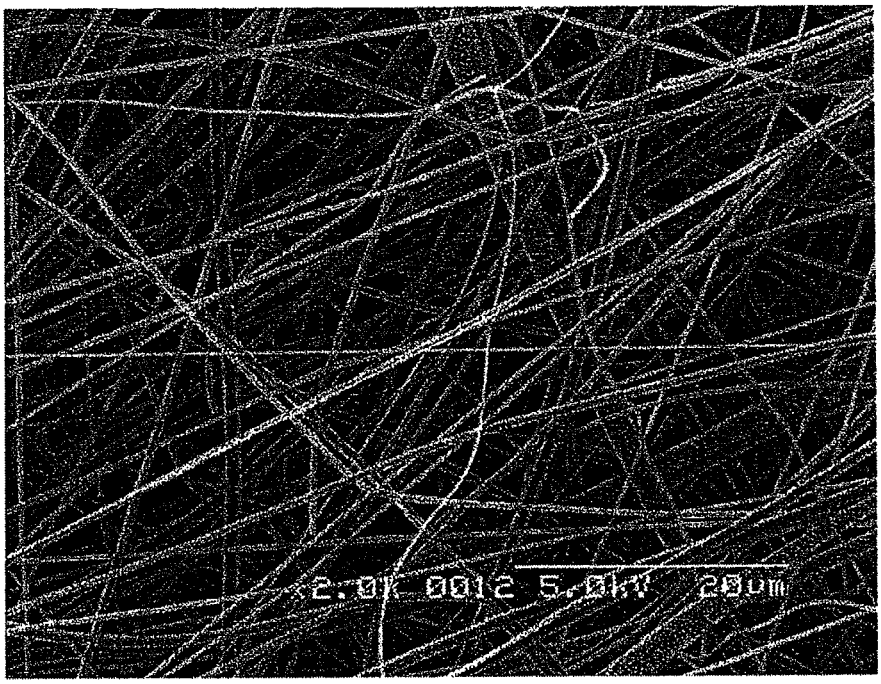
FIG. 19 is an electron microscope photograph (2000× magnification) of the surface of a fiber structure obtained by the procedure of Example 6.
Figure 20:
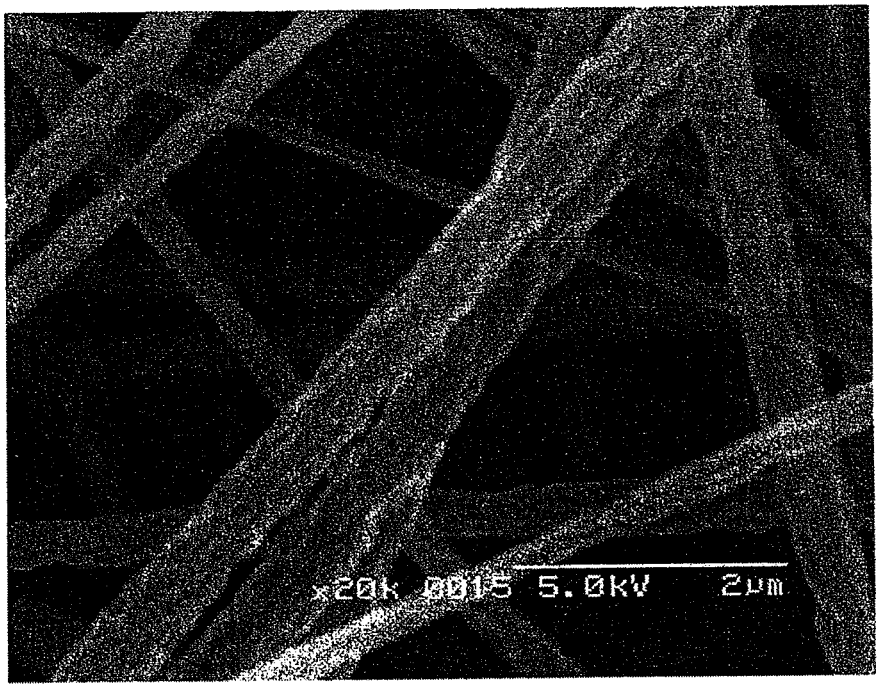
FIG. 20 is an electron microscope photograph (20,000× magnification) of the surface of a fiber structure obtained by the procedure of Example 6.

Scanning electron micrographs of the nonwoven fabric surface are shown in FIGS. 19 and 20.

Example 7

The same procedure was carried out as in Example 1, except for using 1 part by weight of polylactic acid-polyglycolic acid copolymer (copolymerization ratio=75:25) (Mitsui Chemical Co., Ltd.), 3 parts by weight of ethanol (reagent grade, by Wako Pure Chemical Industries Co., Ltd.) and 6 parts by weight of methylene chloride (reagent grade, by Wako Pure Chemical Industries Co., Ltd.). The mean fiber size was 1.4 μm, and no filaments with a fiber size of greater than 3 μm were observed. The nonwoven fabric thickness was 130 μm, and the mean apparent density was 85 kg/m$^3$.

Figure 21:
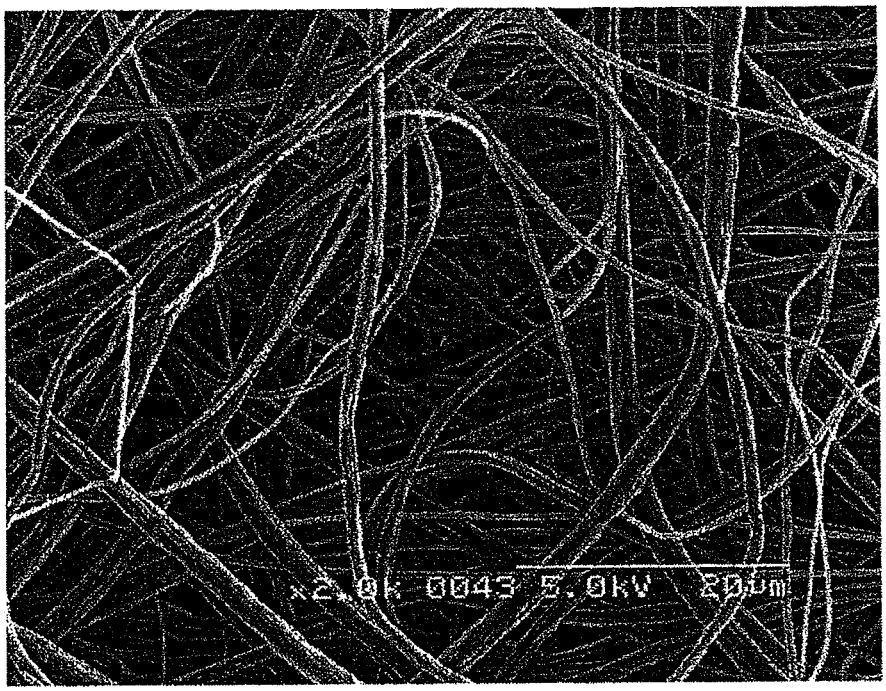
FIG. 21 is an electron microscope photograph (2000× magnification) of the surface of a fiber structure obtained by the procedure of Example 7.
Figure 22:
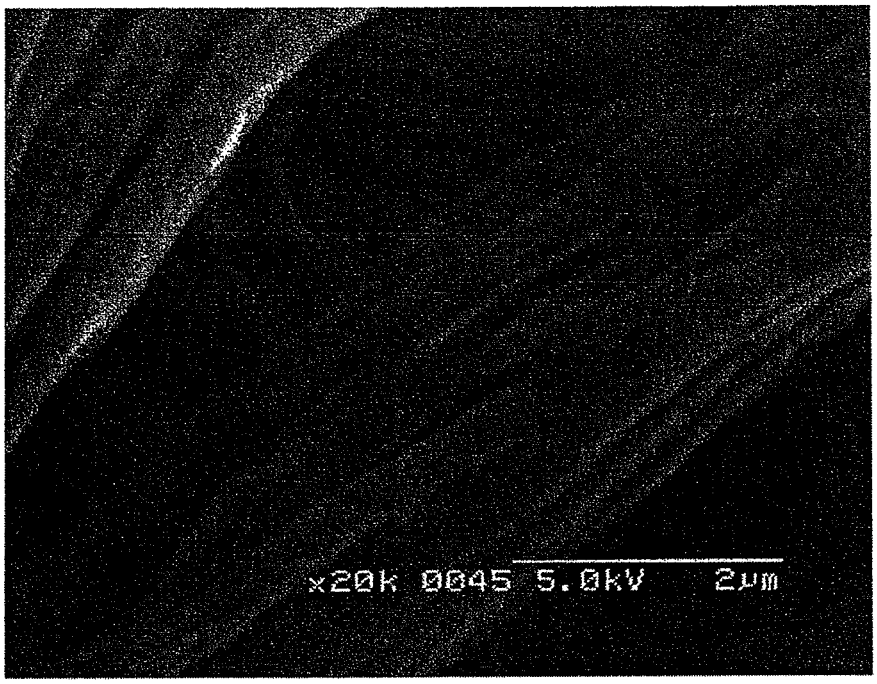
FIG. 22 is an electron microscope photograph (20,000× magnification) of the surface of a fiber structure obtained by the procedure of Example 7.

Scanning electron micrographs of the nonwoven fabric surface are shown in FIGS. 21 and 22.

The invention claimed is:

1. A process for production of a nonwoven fabric, which comprises a step wherein a thermoplastic polymer is dissolved in a mixed solvent composed of a volatile good solvent for the polymer and a volatile poor solvent for the polymer, a step wherein the resulting solution is spun by an electrospinning method and a step wherein a nonwoven fabric accumulated on a collecting sheet is obtained, which process yields a nonwoven fabric with a mean fiber size of 0.1-20 μm, wherein the nonwoven fabric is an aggregate of filaments and any given lateral cross-section of said filaments is irregular, and a mean apparent density in the range of 10-95 kg/m$^3$, wherein the irregular shape is at least one selected from the group consisting of 0.1-1 μm pits on filament surfaces, 0.1-1 μm protrusions on filament surfaces, pits formed in a linear fashion in the fiber axis direction on filament surfaces, protrusions formed in a linear fashion in the fiber axis direction on filament surfaces and micropores in filament surfaces, formed either alone or present in combinations so long as any given lateral cross-section is irregular, the thermoplastic polymer is polylactic acid or poly(lactic-co-glycolic acid), the volatile good solvent for the polymer is methylene chloride, and the volatile poor solvent for the polymer is ethanol, methanol, isopropanol, acetone, or acetonitrile, wherein the ratio of the volatile poor solvent for the polymer and volatile good solvent for the polymer in said mixed solvent is in the range of (23:77) to (40:60), based on weight.

2. A process for production of a nonwoven fabric according to claim 1, wherein the thermoplastic polymer is polylactic acid.

3. A process for production of a nonwoven fabric according to claim 1, wherein the volatile poor solvent for the polymer is ethanol.

4. A process for production of a nonwoven fabric according to claim 1, wherein the ratio of the volatile poor solvent for the polymer and volatile good solvent for the polymer in said mixed solvent is in the range of (25:75) to (40:60), based on weight.

5. A process for production of a nonwoven fabric according to claim 4, wherein the ratio of the volatile poor solvent for the polymer and volatile good solvent for the polymer in said mixed solvent is in the range of (30:70) to (40:60), based on weight.

6. A process for production of a nonwoven fabric according to claim 1, wherein the mean apparent density in the range of 50-95 $kg/m^3$.

7. A process for production of a nonwoven fabric according to claim 1, wherein the volatile poor solvent for the polymer is methanol.

8. A process for production of a nonwoven fabric according to claim 1, wherein the volatile poor solvent for the polymer is isopropanol.

9. A process for production of a nonwoven fabric according to claim 1, wherein the nonwoven fabric has a thickness of at least 100 μm.

10. A process for production of a nonwoven fabric according to claim 1, wherein the nonwoven fabric has a thickness of at least 170 μm.

11. A process for production of a nonwoven fabric according to claim 1, further comprising forming a stack of the nonwoven fabric.

12. A process for production of a nonwoven fabric according to claim 10, wherein the thermoplastic polymer is polylactic acid.

13. A process for production of a nonwoven fabric according to claim 10, wherein the volatile poor solvent for the polymer is ethanol.

14. A process for production of a nonwoven fabric according to claim 10, wherein the volatile poor solvent for the polymer is methanol.

15. A process for production of a nonwoven fabric according to claim 10, wherein the volatile poor solvent for the polymer is isopropanol.

* * * * *